United States Patent [19]

Herkimer

[11] Patent Number: 4,813,149

[45] Date of Patent: Mar. 21, 1989

[54] LEVEL DEVICE

[76] Inventor: Robert D. Herkimer, 1290 Andover Ct., Sandy, Utah 84070

[21] Appl. No.: 127,182

[22] Filed: Dec. 1, 1987

[51] Int. Cl.[4] ..... B43L 7/06

[52] U.S. Cl. ..... 33/462; 33/451

[58] Field of Search ..... 33/451, 459, 460, 461, 33/462, 456, 452, 464, 465

[56] References Cited

U.S. PATENT DOCUMENTS

| | | | |
|---|---|---|---|
| 94,814 | 9/1869 | Fales | 33/462 |
| 896,847 | 8/1908 | Messner | 33/462 |
| 1,601,138 | 9/1926 | Moore | 33/462 |
| 1,624,535 | 4/1927 | Christianson | 33/461 |
| 2,332,347 | 10/1943 | Schaefer et al. | 33/461 |
| 3,991,474 | 11/1976 | Rath | 33/462 |
| 4,562,649 | 1/1986 | Ciavarella | 33/465 X |

FOREIGN PATENT DOCUMENTS

| | | | |
|---|---|---|---|
| 2814712 | 3/1979 | Fed. Rep. of Germany | 33/465 |

*Primary Examiner*—Harry N. Haroian

*Attorney, Agent, or Firm*—Jerry T. Kearns

[57] ABSTRACT

A level device has an extendable body portion with a pair of pivotally mounted extendable swingers. The swingers may be adjusted to swing freely, or be locked at any desired angular position. A protractor scale on the pivot mount of each swinger provides an indication of the angle of the swinger with respect to the main body portion. A spirit level is also provided on the pivot mount of each of the swingers to allow the body portion to be held in a horizontal level position. The device is useful for hanging pictures on walls, locating shelves, drawing designs on walls and measuring operations.

5 Claims, 4 Drawing Sheets

LEVEL DEVICE

BACKGROUND OF THE INVENTION

1. Field of the Invention

The present invention relates to level devices, and more particularly pertains to a level device which may be utilized to provide reference markings on planar vertical and horizontal surfaces. Various different tasks require the placement of accurate reference marks on vertical wall surfaces. Presently, it is necessary to employ both a spirit level and a measuring scale to accurately locate such reference marks. By combining a leveling device with horizontal and vertical expandable measuring scales, the present invention allows the task to be performed by the manipulation of only a single measuring instrument.

2. Description of the Prior Art

Various types of level devices are known in the prior art. A typical example of such a level device is to be found in U.S. Pat. No. 634,657, which issued to R. Young on Oct. 10, 1899. This patent discloses a plumb level with a protractor scale designed to be clamped on an implement to measure the degree of incline. U.S. Pat. No. 714,957, which issued to 0. Sinigar on Dec. 2, 1902, discloses a plumb level with a scale for indicating the degree of incline. U.S. Pat. No. 834,132, which issued to G. Hicks et al on Oct. 23, 1906, discloses a spirit level having a pair of clamps to removably clamp the level to a straight edge. U.S. Pat. No. 2,234,436, which issued to B. King on Mar. 11, 1941, discloses an inclinometer with a gear actuated pointer for indicating the degree of incline on a protractor Oct. 19, 1954, discloses an extensible level which utilizes a spirit level and a protractor scale for indicating the degree of incline of the surface of the ground.

While the above mentioned devices are suited for their intended usage, none of these devices disclose a level with an extendable body portion having a pair of pivotally mounted extendable swingers. Additionally, none of the aforesaid patents disclose the use of a protractor scale in conjunction with the swinger pivot mounting to enable the swingers to be independently locked in any desired angular position. Inasmuch as the art is relatively crowded with respect to these various types of level devices, it can be appreciated that there is a continuing need for and interest in improvements to such level devices, and in this respect, the present invention addresses this need and interest.

SUMMARY OF THE INVENTION

In view of the foregoing disadvantages inherent in the known types of level devices now present in the prior art, the present invention provides an improved level device. As such, the general purpose of the present invention, which will be described subsequently in greater detail, is to provide a new and improved level device which has all the advantages of the prior art level devices and none of the disadvantages.

To attain this, a representative embodiment of the concepts of the present invention is illustrated in the drawings and makes use of an elongated extendable body portion having an extendable swinger pivotally mounted at each end. Each pivotable swinger mounting is provided with a spirit level and a protractor scale for indicating the angle of the swinger with respect to the body portion. Each swinger is provided with a lock collar for selectively securing the swinger in an angular adjusted position, or to allow the swinger to swing freely. The body portion and swingers are provided with extendable measuring scales which allow the device to be collapsed to a compact storage position.

There has thus been outlined, rather broadly, the more important features of the invention i order that the detailed description thereof that follows may be better understood, and in order that the present contribution to the art may be better appreciated. There are, of course, additional features of the invention that will be described hereinafter and which will form the subject matter of the claims appended hereto. In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting. As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved level device which has all the advantages of the prior art level devices and none of the disadvantages.

It is another object of the present invention to provide a new and improved level device which may be easily and efficiently manufactured and marketed.

It is a further object of the present invention to provide a new and improved level device which is of a durable and reliable construction.

An even further object of the present invention is to provide a new and improved level device which is susceptible of a low cost of manufacture with regard to both materials and labor, and which accordingly is then susceptible of low prices of sale to the consuming public, thereby making such level devices economically available to the buying public.

Still yet another object of the present invention is to provide a new and improved level device which provides in the apparatuses and methods of the prior art some of the advantages thereof, while simultaneously overcoming some of the disadvantages normally associated therewith.

Still another object of the present invention is to provide a new and improved level device which utilizes a pair of pivotally mounted swingers on an extendable body portion for conveniently providing reference markings on a vertical or horizontal surface.

Yet another object of the present invention is to provide a new and improved level device which utilizes a pair of swingers pivotally mounted on an extendable body portion by a protractor scale which allows the swingers to be selectively locked in any desired angular position.

Even still another object of the present invention is to provide a new and improved level device which utilizes an extendable body portion and a pair of pivotally mounted swingers with extendable measuring scales to allow a wide variety of measuring operations to be performed utilizing a single instrument.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
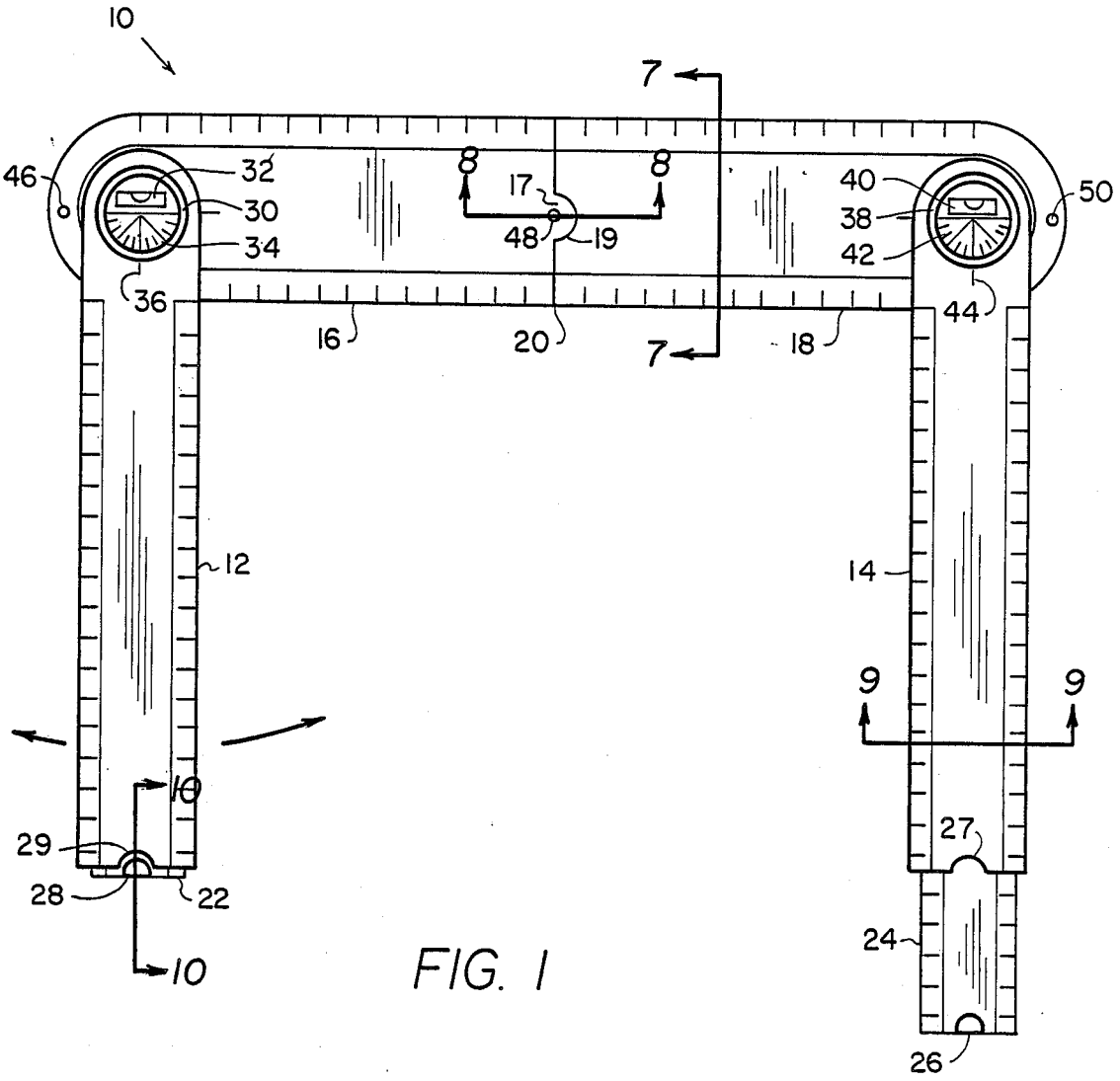
FIG. 1 is a top plan view of the level device of the present invention.

With reference now to the drawings, and in particular to FIG. 1 thereof, a new and improved level device embodying the principles and concepts of the present invention and generally designated by the reference numeral 10 will be described.

More specifically, it will be noted that the first embodiment 10 of the invention includes a first vertical swinger 12 and a second vertical swinger 14. The first swinger 12 is pivotally connected to a left hand portion 16 of the extendable base. The second swinger 14 is pivotally connected to the right hand portion 18 of the extendable base. The left hand portion 16 and right hand portion 18 mate at an abutment joint 20 when in a retracted position. The joint 20 is composed of an arcuate projection 17 on the left hand portion 16 which is received in a cooperating notch 19 formed on the right hand base portion 18. An extension 22 of the swinger 12 is slidably received in a longitudinal slot centrally disposed in the swinger 12. The swinger 14 has a corresponding extension portion 24. The extension 22 of the swinger 12 has an upstanding arcuate projection 28 which is received in an arcuate notch 29 on the swinger 12. The swinger 14 has a similar recess 27 for engagement with an upstanding projection 26 on the extension 24. The swinger 12 is pivotally mounted on a pivot mount 30 secured to the left hand base portion 16. The pivot mount 30 is provided with a spirit level 32 and a protractor scale 34. An index mark 36 on the swinger 12 cooperates with the protractor scale 34 to provide an indication of the angle between the swinger 12 and the base portion 16. The swinger 14 is similarly mounted on a pivot mount 38 provided with a spirit level 40 and a protractor scale 42. An index mark 44 on the swinger 14 cooperates with the protractor scale 42. Three small circular apertures 46, 48 and 50 are provided for temporarily securing the base portions 16 and 18 to a work surface. Each of the swingers 12 and 14, swingers extensions 22 and 24, the left hand base portion 16 and right hand base portion 18 are provided with measuring scales which may be marked in any desired scale, for example in inches or in a metric scale.

Figure 2:
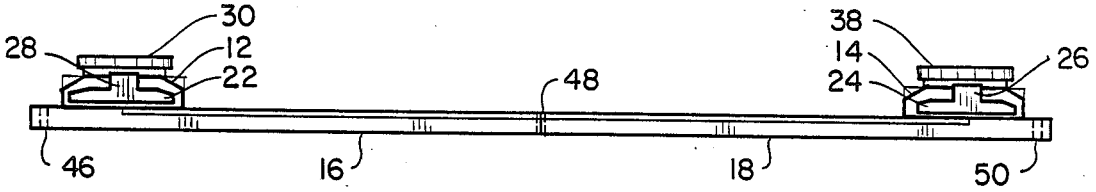
FIG. 2 is a front view of the level device of the present invention.

With reference now to FIG. 2, a front view is provided illustrating the swingers 12 and 14 pivotally mounted on the base portions 16 and 18.

Figure 3:
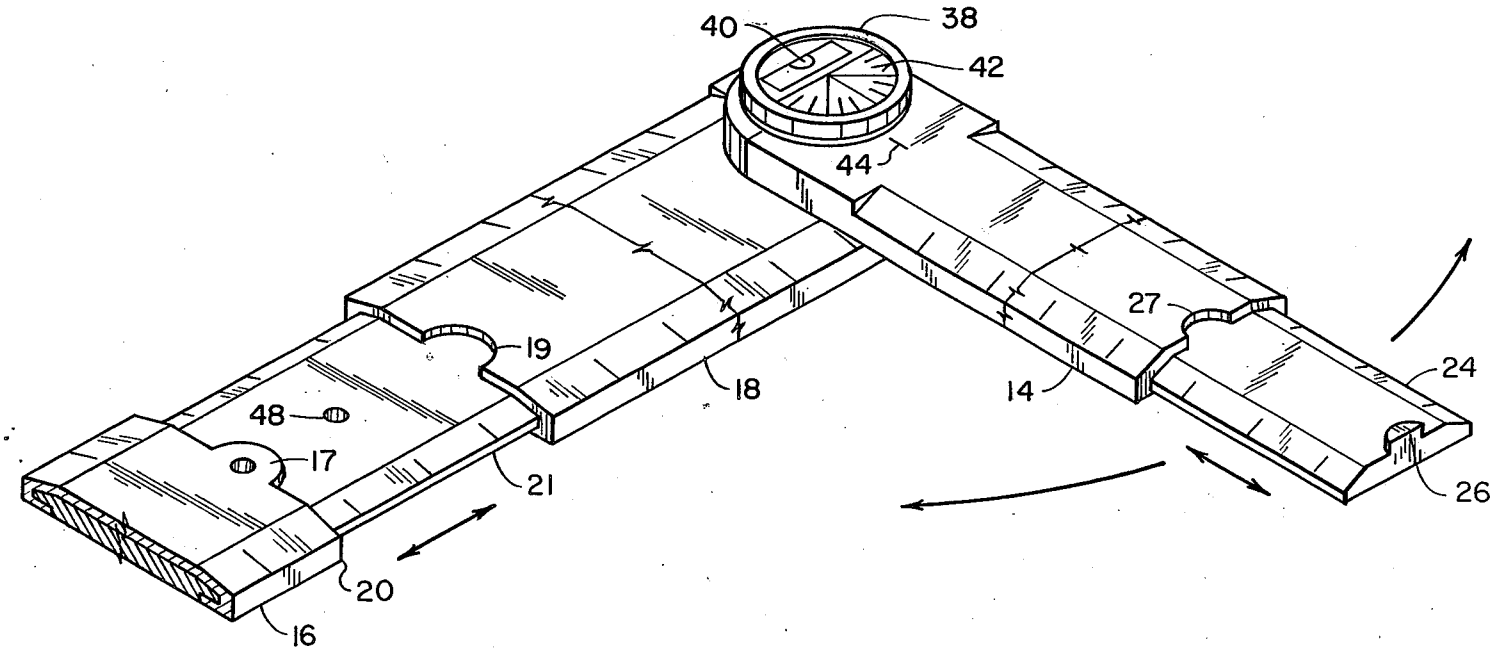
FIG. 3 is a partial perspective view illustrating the extendable construction of the level device of the present invention.

In FIG. 3, a partial perspective view is provided illustrating the left hand base portion 16 and right hand base portion 18 moved to a partially extended position. In the illustrated position, it may be seen that the base extension 21 is slidably received within slots in the left hand 16 and right hand 18 base portions. The extendibility of the level device 10 of the present invention allows the device to be utilized with a variety of different sized work surfaces and also permits the device to be compacted for easy storage and transportability.

Figure 4:
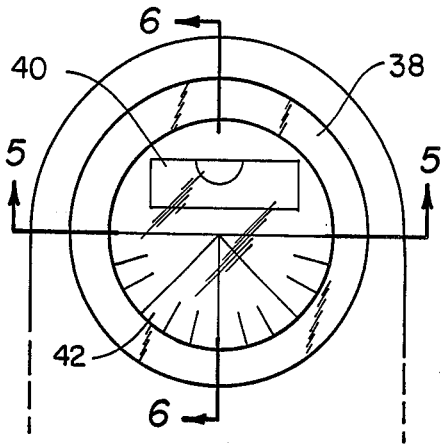
FIG. 4 is a detail view illustrating a pivotable swinger mount of the level device of the present invention.

With reference now to FIG. 4, a plan detail view is provided illustrating the pivot mount 38 for the swinger 14.

Figure 5:
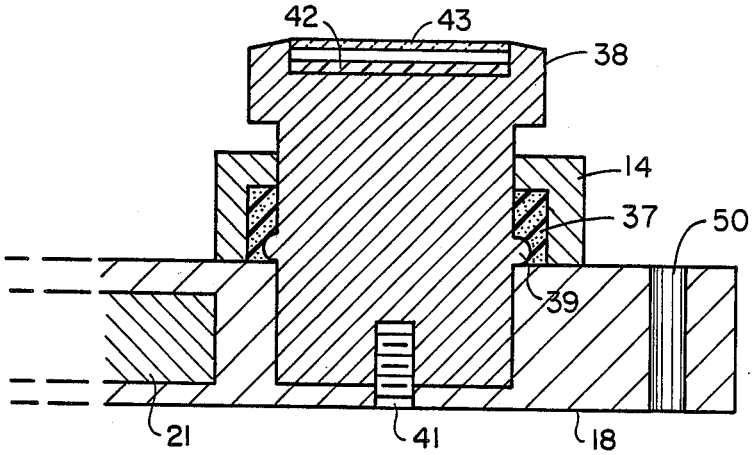
FIG. 5 is a cross sectional view taken along line 5—5 of FIG. 4 illustrating the details of construction of the pivotable swinger mount.

With reference now to FIG. 5, across sectional view taken along line 5—5 of FIG. 4 is provided, and illustrates the constructional details of the pivot mount 38. The protractor scale 42 is received within a recess on the top surface of the pivot mount 38. A transparent glass or plastic cover is provided over the protractor scale 42. The pivot mount 38 is secured to the right hand base portion 18 via a threaded fastener 41. The swinger 14 has a circular aperture which receives the pivot mount 38. A circular rubber lock collar 37 is received in a step lower portion of the swinger 14. The lock collar 37 has an annular groove which receives an annular rib 39 formed on the pivot mount 38. In the illustrated position, the engagement of the lock collar 37 with the rib 39 locks the swinger 14 to the pivot mount 38 in a fixed angular relation with the base portion 18.

Figure 6:
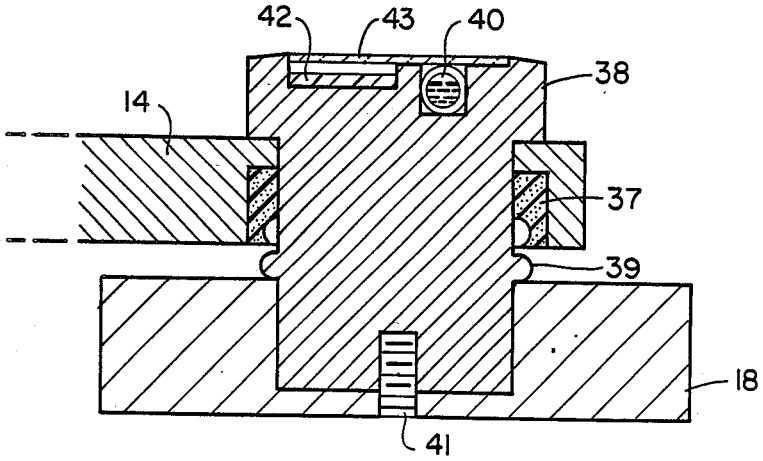
FIG. 6 is a cross sectional view taken along line 6—6 of FIG. 4 illustrating the details of the pivotable swinger mount of the level device of the present invention.

In FIG. 6, the swinger 14 is illustrated in a raised position in which the swinger 14 swings freely about the pivot mount 38. Thus, the swinger 14 may be moved to any desired angular relation with respect to the base portion 18. By depressing the swinger 14 downwardly toward the base portion 18, the lock collar 37 may be caused to engage the rib 39, thus securing the swinger 14 in any desired adjusted position.

Figure 7:
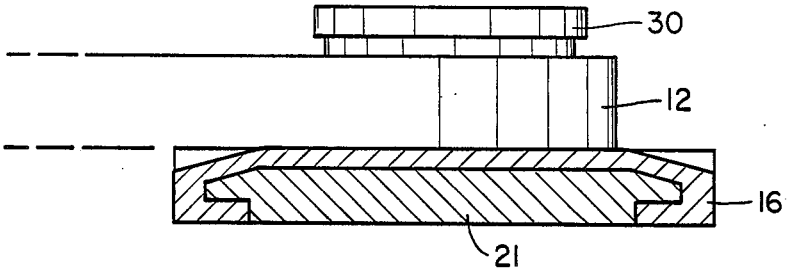
FIG. 7 is a cross sectional view taken along line 7—7 of FIG. 1 illustrating the extendable construction of the body portion of the level device of the present invention.

In the cross sectional detail view of FIG. 7, the base extension 21 is shown slidably received in the base portion 16. The swinger 12 is pivotally mounted by the pivot mount 30.

Figure 8:
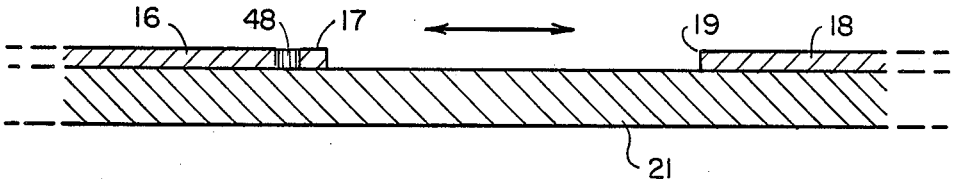
FIG. 8 is a cross sectional view taken along line 8—8 of FIG. 1 also illustrating the extendable construction of the body portion of the level device of the present invention.

In the longitudinal cross sectional detail view of FIG. 8, it may be seen that the base extension 21 is slidably received in both the left hand 16 and right hand 18 base portions. Thus, the base may be extended to a wide variety of different lengths.

Figure 9:
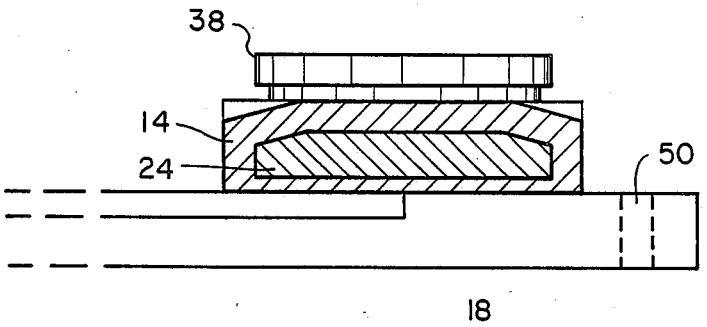
FIG. 9 is a cross sectional view taken along line 9—9 of FIG. 1 also illustrating the extendable construction of the swinger of the level device of the present invention.

In the transverse cross sectional view of FIG. 9, the swinger extension 24 is shown slidably received within a longitudinal slot centrally disposed in the swinger 14.

Figure 10:
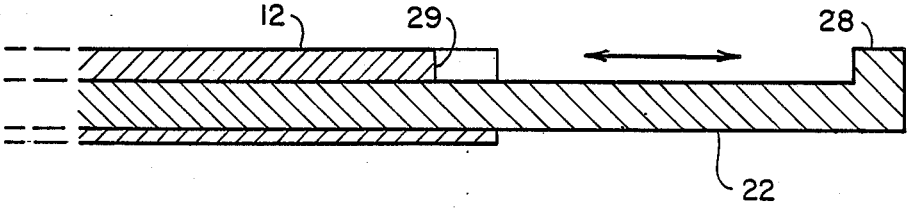
FIG. 10 is a cross sectional view taken along line 10—10 of FIG. 1 illustrating the extendable construction of the swinger of the level device of the present invention.

In FIG. 10, a longitudinal cross sectional view is provided illustrating the swinger extension 22 slidably received in a longitudinal slot centrally disposed within the swinger 12.

With reference now to FIGS. 1, 5 and 6, the manner of usage of the level device 10 of the present invention will now be described. The base 16 and 18 is held against a vertical wall surface or temporarily secured by pins or small nails through the holes 46, 48 and 50. In utilizing the device to make reference marks for hanging a picture, the swingers 12 and 14 are moved to the unlock position illustrated in FIG. 6. This allows the swingers to seek a vertical level as indicated by the reference mark 36 and 44 in cooperation with the protractor scales 34 and 42. The swingers 12 and 14 indicate a vertical positioning in the manner of a plumb bob. Once a vertical position has been achieved, the swingers 12 and 14 may be moved to their locked position as illustrated in FIG. 5, and suitable reference marks may be drawn on the wall utilizing the scales on the swingers 12 and 14 and the base portions 16 and 18. In the event that a large picture is to be hung, the base portions 16 and 18 may be extended apart and the swinger extensions 22 and 24 may be extended to an appropriate length. The spirit levels 32 and 40 may be utilized to attain a horizontal positioning of the base portions 16 and 18. Through the use of protractor scales 34 and 42, the swingers 12 and 14 may be utilized to provide reference markings at any desired angle.

The level device 10 of the present invention may be constructed from any conventional materials such as wood, metal or plastic. It is contemplated that the extensions 21, 22 and 24 will be received in the slots in the base portions and swingers in a relatively snug fitting frictional engagement. In this fashion, the extensions will retain their adjusted positions.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A new and improved level device, comprising:
elongated base means;
elongated swinger means pivotally mounted at opposite ends of said elongated base means;
pivot mount means at opposite ends of said base means for selectively mounting said swinger means for free swinging movement or for securing said swinger means at a selected angular position;
protractor scale means on each of said pivot mount means;
reference mark means on each of said swinger means for cooperation with said protractor scale means;
measuring scale means on said base means and each of said swinger means;
said elongated base having a left hand base portion and a right hand base portion connected by a base extension;
said base extension slidably received within longitudinal slots centrally disposed in said left and right hand base portions;
and
an arcuate projection formed on one end of said left hand base portion and a cooperating arcuate recess formed on one end of said right hand base portion.

2. The level device of claim 1, further comprising spirit level means on a top surface of each of said pivot mount means.

3. The level device of claim 1, wherein each of said pivot mount means has a circular annular rib for engagement with a circular groove on a lock collar provided on each of said swinger means.

4. A new and improved level device, comprising:
an elongated base;
said base having a left hand portion and a right hand portion;
a base extension slidably received in longitudinal slots centrally disposed in said left and right hand base portions;
a pair of upstanding generally cylindrical pivot mounts secured to opposite ends of said base;
a spirit level and a protractor scale provided on a top surface of each of said pivot mounts;
a circular annular rib around each of said pivot mounts;
a pair of elongated swingers pivotally mounted on said pivot mounts;
each of said swingers having a circular aperture received around one of said pivot mounts;
a rubber lock collar on each of said swingers surrounding said aperture and having a circular groove for receiving said circular annular rib on said pivot mount;
said swinger lock collars movable between a freely swingable position and a lock position;
a pair of swinger extensions received in central longitudinal slots in said swingers;

a measuring scale on each of said base, said base extension, said swingers and said swinger extensions.

5. A new and improved level device, comprising:

elongated base means;

elongated swinger means pivotally mounted at opposite ends of said elongated base means;

pivot mount means at opposite ends of said base means for selectively mounting said swinger means for free swinging movement or for securing said swinger means at a selected angular position;

protractor scale means on each of said pivot mount means;

reference mark means on each of said swinger means for cooperation with said protractor scale means;

measuring scale means on said base means and each of said swinger means;

swinger extension means on each of said swinger means;

said swinger extension means comprising an elongated swinger extension slidably received within a centrally disposed longitudinal slot in each of said swinger means; and each of said elongated swinger extensions having an upstanding arcuate projection for cooperation with an arcuate recess formed at one end of each of swinger means.

* * * * *